US009388011B2

(12) United States Patent
Mutsuno

(10) Patent No.: US 9,388,011 B2
(45) Date of Patent: Jul. 12, 2016

(54) PRINTING SYSTEM, SHEET PROCESSING METHOD IN THE PRINTING SYSTEM, AND STORAGE MEDIUM

(71) Applicant: CANON KABUSHIKI KAISHA, Tokyo (JP)

(72) Inventor: Masahiro Mutsuno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/328,526

(22) Filed: Jul. 10, 2014

(65) Prior Publication Data

US 2014/0319767 A1 Oct. 30, 2014

Related U.S. Application Data

(62) Division of application No. 13/171,216, filed on Jun. 28, 2011, now abandoned.

(30) Foreign Application Priority Data

Jul. 1, 2010 (JP) ..... 2010-151226

(51) Int. Cl.
*B65H 31/24* (2006.01)
*B65H 43/06* (2006.01)

(52) U.S. Cl.
CPC ..... *B65H 31/24* (2013.01); *B65H 43/06* (2013.01); *B65H 2511/30* (2013.01); *B65H 2511/415* (2013.01); *B65H 2513/42* (2013.01); *B65H 2801/06* (2013.01)

(58) Field of Classification Search
CPC ..... B65H 29/58; B65H 29/60; B65H 31/24; B65H 43/06; B65H 2301/4217; B65H 2511/30; B65H 2511/415; B65H 2801/06; B65H 2513/42
USPC ..... 271/176, 298
See application file for complete search history.

(56) References Cited

U.S. PATENT DOCUMENTS

| | | | | |
|---|---|---|---|---|
| 8,074,984 | B2 * | 12/2011 | Kurohata | 271/292 |
| 2008/0042342 | A1 * | 2/2008 | Tominaga et al. | 271/298 |
| 2008/0154426 | A1 * | 6/2008 | Kikuchi | 700/219 |
| 2010/0156024 | A1 * | 6/2010 | Tanaka | 271/3.14 |
| 2012/0001387 | A1 * | 1/2012 | Mutsuno | 271/298 |
| 2012/0267849 | A1 * | 10/2012 | Mutsuno | 271/279 |

FOREIGN PATENT DOCUMENTS

| | | | |
|---|---|---|---|
| JP | 2001-042749 | A | 2/2001 |
| JP | 2001-106418 | A | 4/2001 |
| JP | 2004-310746 | A | 11/2004 |
| JP | 2006-315812 | A | 11/2006 |
| JP | 2007-062907 | A | 3/2007 |
| JP | 2010-107929 | A | 5/2010 |

* cited by examiner

*Primary Examiner* — David H Bollinger
(74) *Attorney, Agent, or Firm* — Canon USA Inc. IP Division

(57) ABSTRACT

A sheet processing method in a printing system constituted by a sheet processing apparatus including a plurality of paper discharge trays having different sheet stacking capacities, to any of whose paper discharge trays a printed sheet is discharged, and a printing apparatus includes setting which of the paper discharge trays is used first for discharging the sheet, specifying the number of remaining pages of sheets to be discharged by a job to be executed, and executing control for discharging the sheets starting from a paper discharge tray different from the set paper discharge tray according to the specified number of remaining pages and a restriction on a stacking amount on each paper discharge tray.

10 Claims, 15 Drawing Sheets

PRINTING SYSTEM, SHEET PROCESSING METHOD IN THE PRINTING SYSTEM, AND STORAGE MEDIUM

CROSS REFERENCE TO RELATED APPLICATIONS

This application is a Divisional of U.S. patent application Ser. No. 13/171,216 filed Jun. 28, 2011, which claims the benefit of Japanese Patent Application No. 2010-151226 filed Jul. 1, 2010, both of which are hereby incorporated by reference in their entirety.

BACKGROUND OF THE INVENTION

1. Field of the Invention

The present invention relates to a printing system, a sheet processing method in the printing system, and a storage medium.

2. Description of the Related Art

A conventional printing apparatus includes a plurality of output trays which can stack printed sheets. Japanese Patent Application Publication No. 2004-310746 discusses a printing apparatus like this. The conventional printing apparatus stacks printed sheets onto one output tray and when the amount of sheets stacked on the output tray has reached a predetermined amount, changes the output tray and continues stacking of sheets by using another output tray. The printing apparatus controls a paper discharge tray, while stacking the sheets discharged from a fixed sheet discharge port, to descend until the top sheet of the stacked sheets comes to the same vertical position of the sheet discharge port.

The finisher apparatus like this may not always be able to fully utilize the maximum stacking amount of a tray according to the size of the sheet to be stacked, the configuration of the output mechanism, and the order of output trays to be used. For example, when sheets are output to a finisher apparatus including movable output trays, in order to fully use the maximum stacking amount of a lower output tray, it is desired to output the sheets starting from an upper output tray.

This is because in outputting sheets onto the upper output tray, it is required to control the upper output tray to descend before the sheets are output thereon. To paraphrase this, it is required to secure a sufficient space (i.e., sufficiently low position) for descending the upper output tray.

In other words, if a large amount of sheets has been stacked onto the lower output tray, the sufficiently low descending position cannot be available for the upper output tray. Thus, the sheets stacked on the lower output tray prevents the upper output tray from going down to the lower position. Accordingly, sheets cannot be stacked on the upper output tray. As a result, sheets cannot be output to the upper output tray by the maximum stacking amount thereof.

SUMMARY OF THE INVENTION

According to an aspect of the present invention, a printing system constituted by a sheet processing apparatus including a plurality of paper discharge trays having different sheet stacking capacities, to any of whose paper discharge trays a printed sheet is discharged includes a setting unit configured to set which of the paper discharge trays is used first for discharging the sheet, a specifying unit configured to specify the number of remaining pages of sheets to be discharged by a job to be executed, and a control unit configured to execute control for discharging the sheets starting from a paper discharge tray different from the paper discharge tray set by the setting unit according to the number of remaining pages that is calculated and specified by the specifying unit and a restriction on a stacking amount on each paper discharge tray.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the present invention.

DESCRIPTION OF THE EMBODIMENTS

Various exemplary embodiments, features, and aspects of the invention will be described in detail below with reference to the drawings.

[System Configuration of the Entire Print Environment 10000]

In order to deal with the issue described in the description of the related art, a first exemplary embodiment of the present invention corresponds to a print environment different from an office environment, such as a print on demand (POD) environment. Accordingly, in the following description, an exemplary system environment of the entire installation location of the POD environment including a printing system 1000 (the print environment 10000 illustrated in FIG. 1) will be described. The print environment itself can implement the present invention as one of characteristics thereof.

Figure 1:
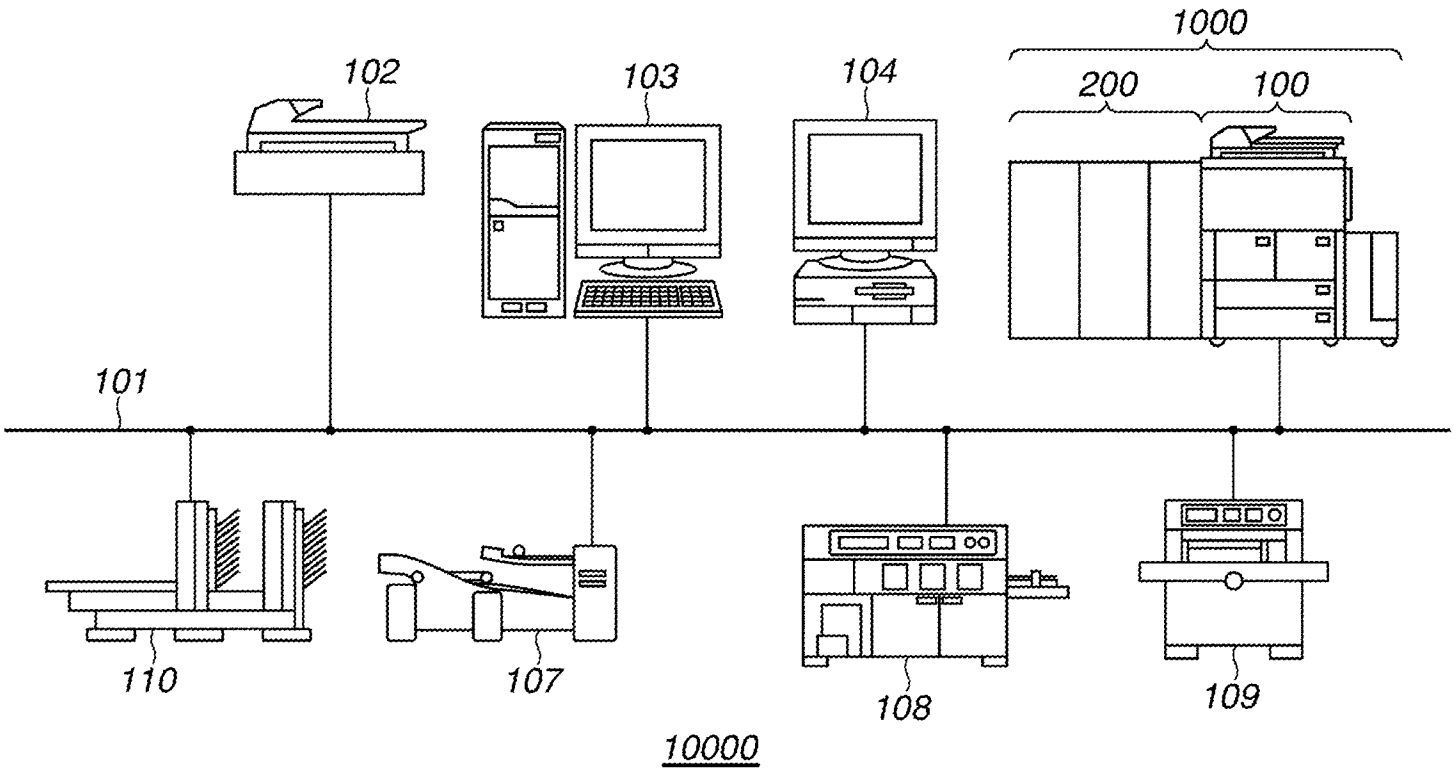
FIG. 1 illustrates an example of a printing system according to an exemplary embodiment of the present invention.

In the present exemplary embodiment, the print environment 10000, to which the printing system 1000 can apply, will be also referred to as the POD system 10000 because the print environment 10000 can be appropriately used in the POD environment. FIG. 1 illustrates an example of the printing system according to the present exemplary embodiment. Referring to FIG. 1, the POD system 10000 includes components, such as the printing system 1000, a server computer 103 (hereafter referred to as a SC 103), and a client computer 104 (hereafter referred to as a PC 104).

In addition, the POD system 10000 includes a paper folding machine 107, a cutting machine 109, a saddle stitch binding machine 110, a case binding machine 108, and a scanner 102. As described above, a plurality of sheet processing apparatuses (finisher apparatuses) are included in the POD system 10000.

The printing system 1000 includes components, such as a printing apparatus 100 and a sheet processing apparatus 200. In the present exemplary embodiment, a multifunction peripheral (MFP), which includes a plurality of functions, such as a copy function and a personal computer (PC) print function, is used as an example of the printing apparatus 100. However, a printing apparatus having a single function only, such as the PC print function or the copy function, can be used as the printing apparatus 100.

In the present exemplary embodiment, the paper folding machine 107, the cutting machine 109, the saddle stitch binding machine 110, and the case binding machine 108 illustrated in FIG. 1 are referred to as sheet processing apparatuses similar to the sheet processing apparatus 200 included in the printing system 1000. This is because that these machines are devices capable of executing sheet processing on a sheet used in a job printed by the printing apparatus 100 of the printing system 1000.

For example, the paper folding machine 107 can execute folding processing on the sheet used in the job printed by the printing apparatus 100. The cutting machine 109 can execute cutting processing on the sheets printed by the printing apparatus 100 in the unit of a sheet bundle, which includes a plurality of sheets.

The saddle stitch binding machine 110 can execute saddle stitch binding on the sheet used in the job printed by the printing apparatus 100. The case binding machine 108 can execute case binding processing on the sheet used in the job printed by the printing apparatus 100. In executing various types of sheet processing on the above-described sheet processing apparatuses, it is required for an operator to remove a printed product of the job printed by the printing apparatus 100 from a paper discharge unit of the printing apparatus 100 and to set the printed product on the sheet processing apparatus used in the processing.

If a sheet processing apparatus different from the sheet processing apparatus 200 of the printing system 1000 is used, it is necessary for the operator to execute an intervention operation after printing by the printing apparatus 100 is completed.

In other words, if sheet processing on the sheet used in the job printed by the printing apparatus 100 is executed by the sheet processing apparatus 200 of the printing system 1000, it is not necessary for the operator to execute an intervention operation after printing by the printing apparatus 100 is completed.

This is because the printing apparatus 100 can directly feed the sheet printed by the printing apparatus 100 to the sheet processing apparatus 200. More specifically, a sheet conveyance path of the printing apparatus 100 can be connected with a sheet conveyance path of the sheet processing apparatus 200. As described above, the sheet processing apparatus 200 and the printing apparatus 100 of the printing system 1000 are physically connected with each other. Further, each of the printing apparatus 100 and the sheet processing apparatus 200 includes a central processing unit (CPU) and can execute data communication under control of each CPU. As described above, the printing apparatus 100 and the sheet processing apparatus 200 are electrically connected with each other.

[Inner Configuration of the System 1000 (Mainly Software Configuration)]

An exemplary inner configuration of the printing system 1000 will be described in detail below with reference to a system block diagram in FIG. 2.

Figure 2:
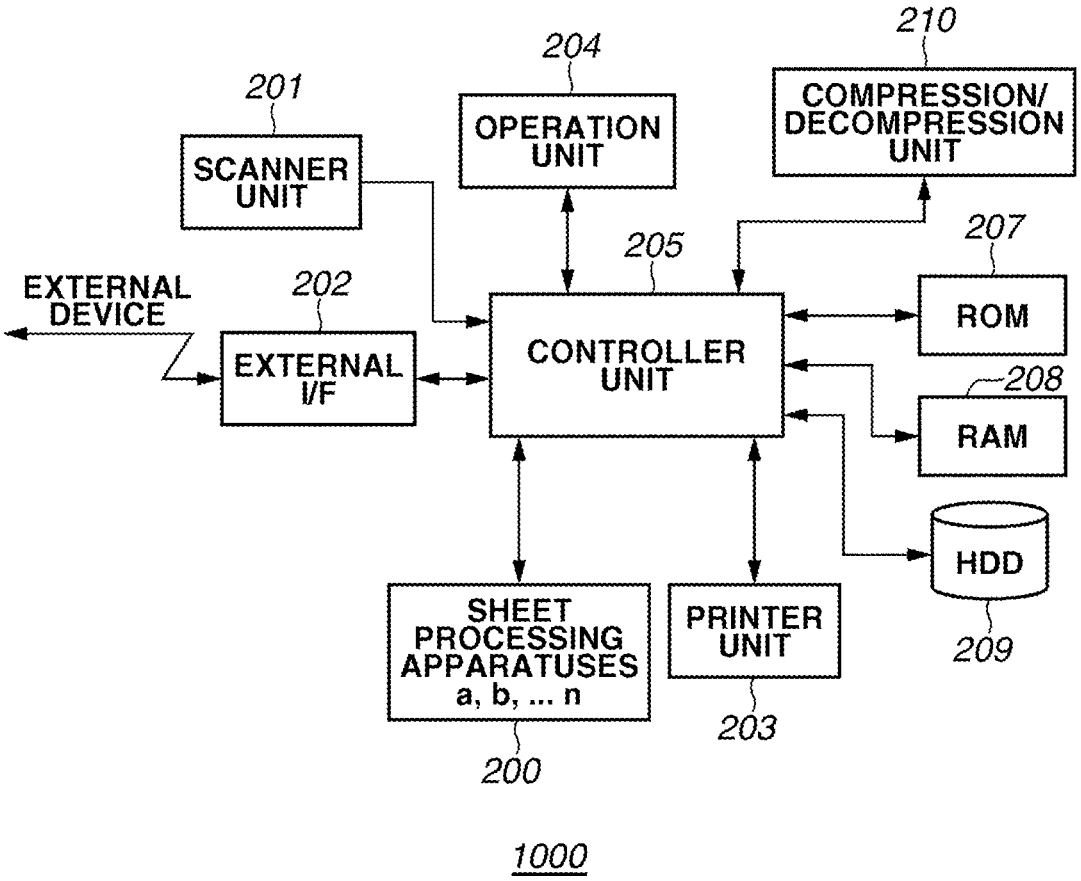
FIG. 2 is a block diagram illustrating an exemplary inner configuration of the printing system illustrated in FIG. 1.

FIG. 2 is a block diagram illustrating the exemplary inner configuration of the printing system 1000 illustrated in FIG. 1. In the present exemplary embodiment, all the units of the printing system 1000 illustrated in FIG. 2 except the sheet processing apparatus 200 (strictly describing, a group of serially provided sheet processing apparatuses, which can include a plurality of inline type sheet processing apparatuses) are included in the printing apparatus 100.

In other words, the sheet processing apparatus 200 can be detachably connected to the printing apparatus 100, and can be provided as an optional apparatus to the printing apparatus 100. With the above-described configuration, an effect of providing inline finishers in the necessary quantity necessary for the POD environment can be implemented. Accordingly, the printing system 1000 has the following configuration.

Referring to FIG. 2, the printing apparatus 100 includes a non-volatile memory, such as a hard disk 209 (hereafter also referred to as the HD 209), which is provided within the printing apparatus 100 and which is capable of storing data of a plurality of jobs to be processed. In addition, the printing apparatus 100 has the copy function for printing job data received from a scanner unit 201 of the printing apparatus 100 with using a printer unit 203 via the HD 209.

Further, the printing apparatus 100 includes the print function for printing the job data received from an external apparatus, such as the SC 103 or the PC 104, via an external interface (I/F) unit 202, which is an example of a communication unit, with using the printer unit 203 via the HD 209. The printing apparatus 100 is an MFP type printing apparatus (hereinafter also referred to as an image forming apparatus) including the plurality of functions described above.

To paraphrase this, the printing apparatus according to the present exemplary embodiment can have any configuration, for example, a printing apparatus capable of executing color printing or monochromatic printing, as long as it can execute various controls according to the present exemplary embodiment.

In the present exemplary embodiment, the printing apparatus 100 includes the scanner unit 201 configured to read an image of a document and execute image processing on data of the read document image. The printing apparatus 100 also includes the external I/F unit 202 configured to transmit and receive information, such as image data, to and from a facsimile apparatus, a network-connected apparatus, and an external dedicated apparatus. Further, the printing apparatus 100 includes the hard disk 209 that can store the image data of a plurality of jobs to be printed, which has been received from either the scanner unit 201 or the external I/F unit 202. Furthermore, the printing apparatus 100 includes the printer unit 203 configured to print the data of a job to be printed, which is stored on the HD 209, on a print medium (a sheet or recording paper).

An operation unit 204 of the printing apparatus 100 includes a display unit, which is an example of a user interface of the printing system 1000. As other examples of the user interfaces provided by the printing system 1000, a display unit, a keyboard, and a mouse of the external apparatus, such as the SC 103 or the PC 104, can be used.

A controller unit (control unit or a CPU), which is an example of a control unit of the printing system 1000, centrally controls processing and an operation performed by various units of the printing system 1000.

A read-only memory (ROM) 207 stores various control programs necessary for the present exemplary embodiment. Further, the ROM 207 stores a display control program for displaying various user interface screens (hereinafter referred to as a UI screen) on the display unit of the operation unit 204. The controller unit 205 loads and executes the program from the ROM 207 to cause the printing apparatus to execute various operations according to the present exemplary embodiment described below.

The ROM 207 also stores a program for executing an operation for interpreting page description language (PDL) code data, which is received from the external apparatus, such as the SC 103 or the PC 104, via the external I/F unit 202 and for rasterizing the PDL data into raster image data (bitmap image data). The operation is processed by software.

The ROM 207 is a read-only memory, which previously stores various programs, such as a boot sequence or font information, and the above-described programs. A random access memory (RAM) 208 is a readable and writable memory and stores image data received from the scanner unit 201 and the external I/F 202 via a memory controller. In addition, the RAM 208 stores various programs and setting information.

The hard disk (HDD) 209 is a mass storage device configured to store image data compressed by a compression/decompression unit 210. The HDD 209 can store a plurality of pieces of data, such as print data of jobs to be processed. The controller unit 205 controls the printer unit 203 to print the data of the job to be processed, which has been input by various input units, such as the scanner unit 201 and the external I/F 202, via the HDD 209.

The controller unit 205 executes control for transmitting data to the external apparatus via the external I/F 202. As described above, the controller unit 205 controls various processing to be executed for outputting data of the processing target job, which has been stored on the HD 209. The compression/decompression unit 210 compresses and decompresses the image data stored on the RAM 208 and the HDD 209 using various compression methods such as Joint Bi-level Image Experts Group (JBIG) or Joint Photographic Experts Group (JPEG).

With the above-described configuration, the controller unit 205, which is an example of the control unit included in the printing system 1000, controls an operation of the inline type sheet processing apparatus 200 as described above with reference illustrated in FIG. 1. In the following description, an exemplary mechanical configuration of the printing system 1000 having the above-described software configuration will be described in detail below with reference illustrated in FIG. 3.

[Apparatus Configuration of the System 1000 (Mainly Mechanical Configuration)]

An exemplary configuration (mechanical configuration) of the printing system 1000 will be described in detail below with reference to an apparatus configuration diagram in FIG. 3.

Figure 3:
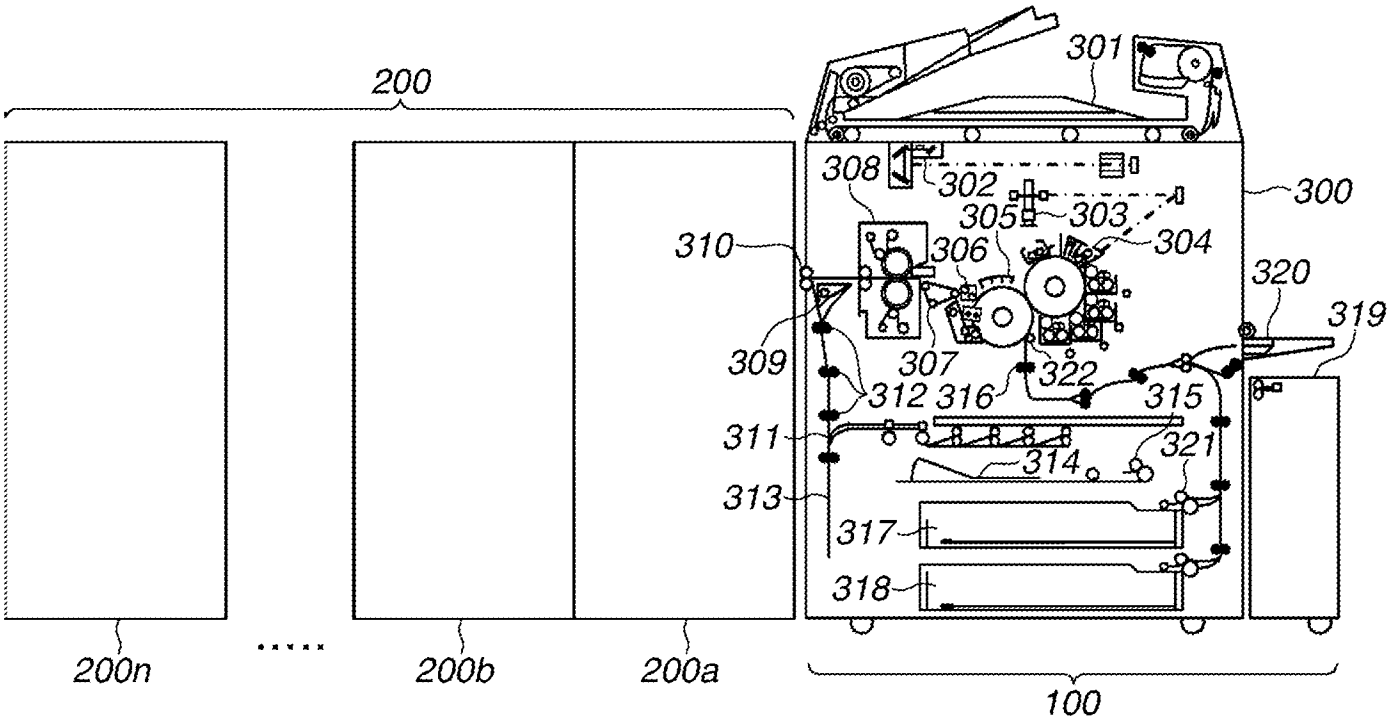
FIG. 3 is a cross section illustrating an exemplary configuration of the printing system illustrated in FIG. 1.

FIG. 3 is a cross section illustrating the exemplary configuration of the printing system 1000 illustrated in FIG. 1. As described above, in the printing system 1000, a plurality of inline type sheet processing apparatuses can be cascade-connected with the printing apparatus 100. In addition, an arbitrary number of inline type sheet processing apparatuses that can be connected to the printing apparatus 100 can be installed in the printing system 1000 in compliance with the environment of utilization of the sheet processing apparatus with specific restrictions.

Accordingly, N sheet processing apparatuses 200 can be connected to the printing apparatus 100 as serially connected group of sheet processing apparatuses as illustrated in FIGS. 2 and 3, for easier understanding. Further, the sheet processing apparatuses 200 include sheet processing apparatuses 200*a*, 200*b*, . . . and 200*n* in this order from the first to the n-th sheet processing apparatus. In other words, an arbitrary number, e.g., three or five, of inline type sheet processing apparatuses 200 can be connected to the printing apparatus 100. In order to improve the utilization efficiency of an offline type sheet processing apparatus, the present exemplary embodiment is configured to correspond to a POD environment which a system administrator may determine that an inline type sheet processing apparatus is unnecessary. More specifically, if no (zero) inline type sheet processing apparatus is utilized, the printing apparatus 100 according to the present exemplary embodiment can be utilized on a standalone basis.

In addition, for example, if a plurality of inline type sheet processing apparatuses is cascade-connected to the printing apparatus 100, a specific user, such as the administrator, can arbitrarily change or determine the order of connection of the plurality of sheet processing apparatuses within a predetermined restriction.

However, because the above-described configuration is intended to improve the user convenience, it is not always necessary to provide the above-described configuration. To paraphrase this, the present invention is not limited to the above-described configuration.

For example, as one example of the configuration applicable to the present invention, the present invention can employ a system configuration in which the number of inline type sheet processing apparatuses that can be utilized in the printing system 1000 and the order of connection of the sheet processing apparatuses are uniformly regulated.

In other words, the present invention can include any system configuration or apparatus configuration that can enable the execution of at least one of the following various types of job control.

[Configuration of the Operation Unit 204, Which is an Example of the UI Unit of the Printing System 1000]

The operation unit 204, which is an example of a user interface unit (hereinafter simply referred to as a UI unit) included in the printing apparatus 100 of the printing system 1000 will be described in detail below with reference to FIGS. 4 and 5.

Figure 4:
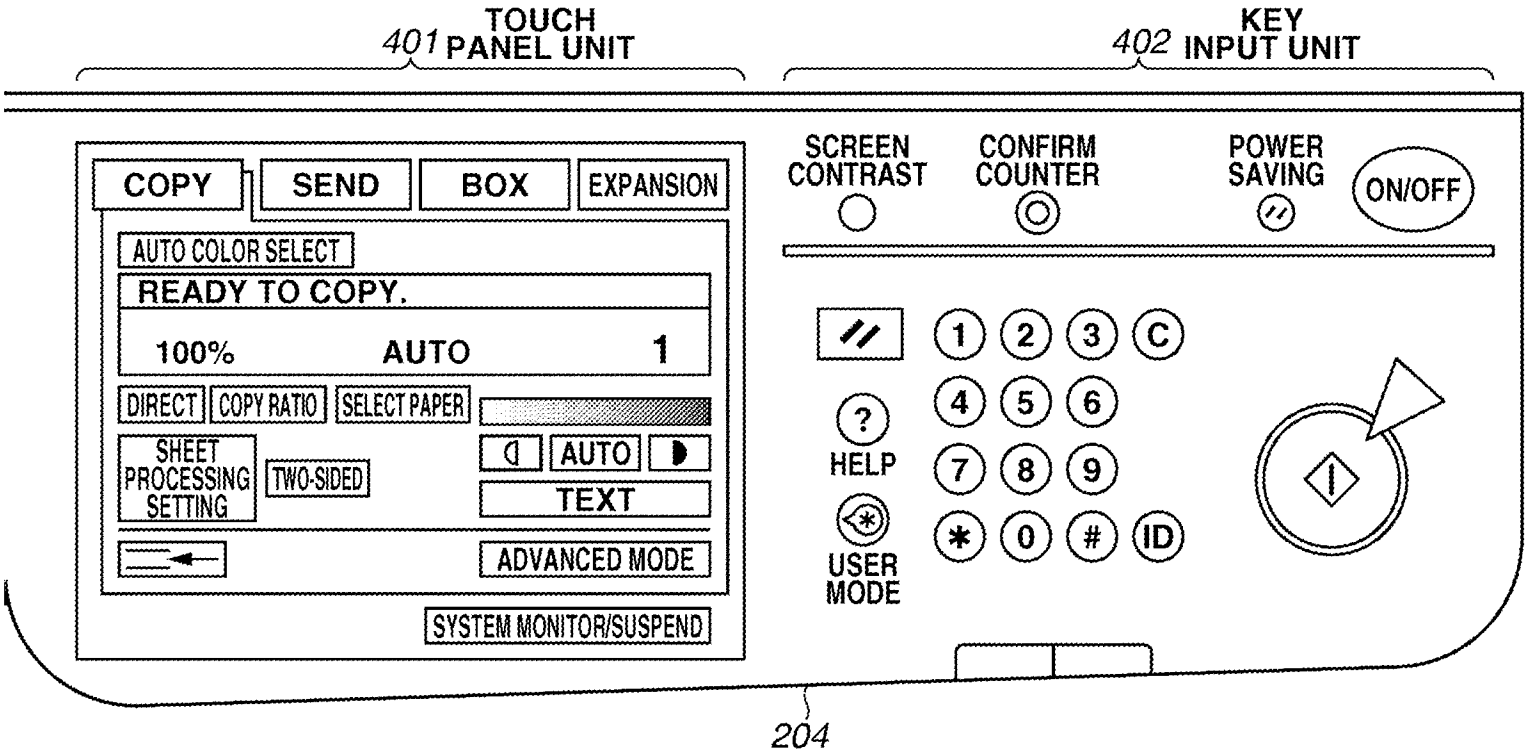
FIG. 4 is a plan view illustrating an exemplary configuration of an operation unit illustrated in FIG. 2.
Figure 5:
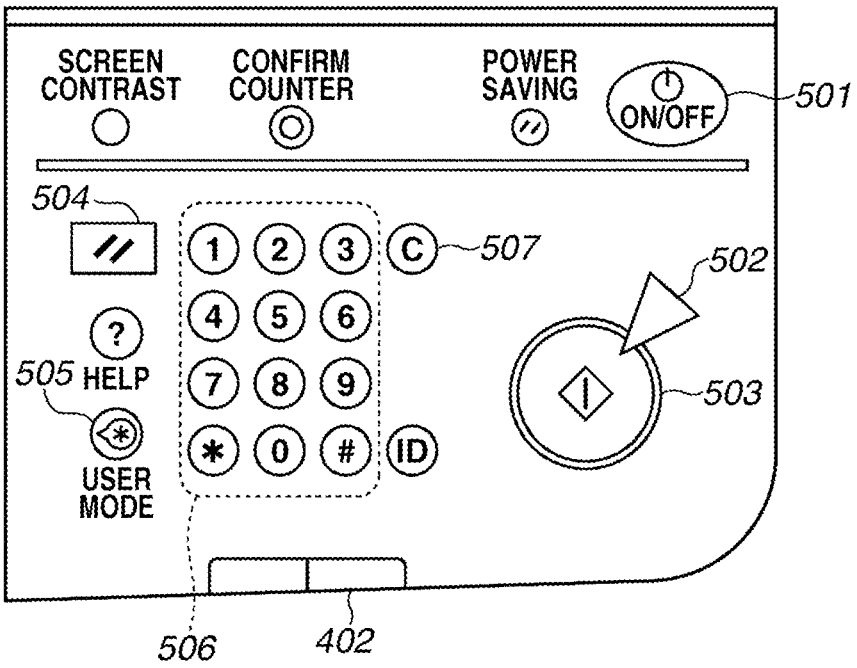
FIG. 5 is a plan view illustrating an exemplary configuration of the operation unit illustrated in FIG. 2.

FIGS. 4 and 5 are plan views illustrating an exemplary configuration of the operation unit 204 illustrated in FIG. 2. FIG. 5 is a plan view illustrating a key input unit of the operation unit 204 illustrated in FIG. 4. Referring to FIG. 4, the operation unit 204 includes a key input unit 402 and a touch panel unit 401. A user operation input via a hard key can be received via the key input unit 402. The touch panel unit 401 is an example of a display unit, via which a user operation input via a soft key (display key) can be received.

Referring to FIG. 5, the key input unit 402 includes an operation unit power switch 501. In response to a user operation of the operation unit power switch 501, the controller unit 205 selectively switches between a standby mode (normal operation state) and a sleep mode (a state in which power consumption is reduced by stopping the operation of a program in an interruption waiting state to prepare for network printing or facsimile transmission). When a main power switch (not illustrated) for starting the power supply to the entire system is turned ON, the controller unit 205 executes control for receiving a user operation input via the operation unit power switch 501.

A start key 503 is a key for receiving a user instruction to cause the printing apparatus 100 to start a specific type of job processing instructed by the user, such as a copy operation or a transmission operation of a job to be processed. A stop key 502 is a key for receiving a user instruction to cause the printing apparatus 100 to suspend the processing of the received job. Numeric keypads 506 are keys that enable the user to set a numerical value for various settings.

A clear key 507 is a key for cancelling various parameters, such as the numerical value set by the user via the numeric keypads 506. A reset key 504 is a key for receiving a user instruction to invalidate all of the various settings set by the user to the job to be processed and to initialize the setting value with default values. A user mode key 505 is a key for shifting a display screen to a system setting screen for each user.

Figure 6:
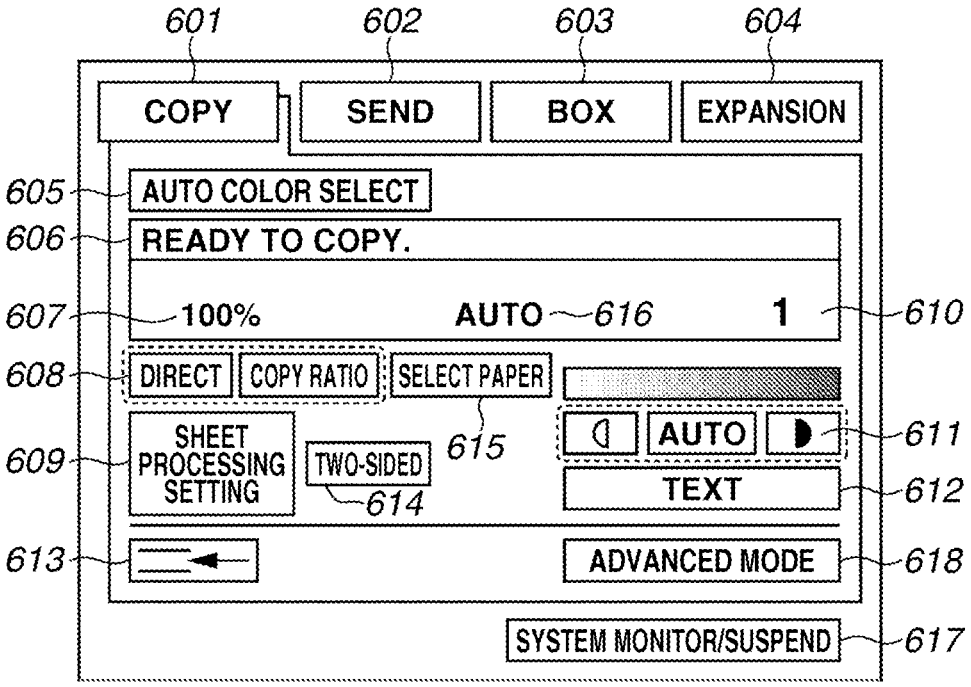
FIG. 6 illustrates an example of a user interface (UI) displayed on the operation unit illustrated in FIG. 2.

FIG. 6 illustrates an example of a UI displayed by the operation unit 204 illustrated in FIG. 2. Referring to FIG. 6, the UI screen is displayed on a touch panel unit (hereinafter simply referred to as a display unit) 401.

Referring to FIG. 6, the touch panel unit 401 includes a liquid crystal display (LCD) (a liquid crystal display unit) and a touch panel display, which is constituted by a transparent electrode attached on the LCD.

The touch panel unit 401 includes both a function for receiving various settings set by the operator and a function for presenting information to the operator. More specifically, if it is detected that a portion of the LCD corresponding to the display key displayed in an enabled state has been pressed by the user, the controller unit 205 executes control for displaying an operation screen corresponding to the key operation on the touch panel unit 401 according to the display control program previously stored on the ROM 207.

The UI screen illustrated in FIG. 6 is an example of an initial screen displayed on the touch panel unit 401 when the printing apparatus 100 is in the standby mode (if no job to be processed by printing apparatus 100 has been input). If a copy tab 601 on the touch panel unit 401 is pressed by the user, the controller unit 205 displays an operation screen for the copy function of the printing apparatus 100 on the touch panel unit 401. If a send tab 602 is pressed by the user, the controller unit 205 displays an operation screen for a data transmission (send) function, which is a function of the printing apparatus 100 for executing transmission by facsimile or e-mail. If a box tab 603 is pressed by the user, the controller unit 205 displays an operation screen for a box function of the printing apparatus 100.

The box function is a function that uses a plurality of data storage boxes (hereafter referred to as a box(es)), which is previously virtually provided on the HDD 209 and which can be independently utilized by each user. When the box function is executed, the controller unit 205 enables the user to select a desired box among a plurality of boxes via the UI unit and receives an operation desired by the user.

More specifically, in response to a user instruction input via the operation unit 204, the controller unit 205 stores document data of a job, which has been received from the scanner unit 201 of the printing apparatus 100, into the user-selected box of the HDD 209. The controller unit 205 stores document data of a job input from the external apparatus, such as the SC 103 or the PC 104, which has been received via the external I/F 202, into the box specified by the user according to a user instruction that has been input by the external apparatus via the UI unit of the external apparatus.

Further, the controller unit 205 controls the printer unit 203 to print the data of the job stored in the box according to the user instruction input via the operation unit 204 in an output format desired by the user. The controller unit 205 transmits the data of the job stored in the box to the external apparatus desired by the user via the external I/F 202.

As described above, in order to enable the user to execute various box operations, the controller unit 205 executes control for displaying the box function operation screen on the touch panel unit 401 in response to the user operation on (pressing of) the box tab 603.

If an expansion tab 604 of the touch panel unit 401 (FIG. 6) is pressed by the user, the controller unit 205 displays a screen for setting an expansion function, such as a scanner setting, on the touch panel unit 401. If a system monitor key 617 is pressed by the user, the controller unit 205 displays a display screen for notifying the user of status of the MFP on the touch panel unit 401.

A color selection setting key 605 is a key for enabling the user to previously select from among "color copy", "monochromatic copy", and "auto select" before starting printing. A copy ratio setting key 608 is a key for displaying a setting screen for setting a copy ratio, such as "direct", "magnify", or "reduce".

If a two-sided key 614 is pressed by the user, the controller unit 205 displays a screen for setting which of one-sided printing and two-sided printing is to be executed by the processing for printing the job to be printed on the touch panel unit 401.

In response to the user operation (pressing) of a sheet selection key 615, the controller unit 205 displays a screen for setting a paper feed unit and the size and type of a sheet (type of a medium) used in the processing for printing the job to be printed on the touch panel unit 401.

If a key 612 is pressed by the user, the controller unit 205 displays a screen for enabling the user to select an image processing mode appropriate for the document image, such as a text mode or a photograph mode, on the touch panel unit 401. A density setting key 611 is a key for adjusting the level of the density of an output image of the job to be printed.

The touch panel unit 401 will be described in detail below with reference illustrated in FIG. 6. The controller unit 205 displays, in a status display field 606 of the touch panel unit 401, a message for prompting the user to check an operation status of an event currently occurring on the printing apparatus 100. The operation status of the current event may include "standby", "warm-up in process", "printing in process", "paper jam", "error", and the like. The controller unit 205 displays, in a display field 607, information for prompting the user to check the copy ratio for the printing of the job to be processed.

Further, the controller unit 205 displays information for prompting the user to check the sheet size and the paper feed mode for the job to be processed in a display field 616. Furthermore, the controller unit 205 displays information for prompting the user to check the number of copies to be printed of the job to be processed and information for notifying the user of the number of the sheets that is currently printed during the printing operation in a display field 610.

In the above-described manner, the controller unit 205 executes control for displaying various information pieces to be notified to the user on the touch panel unit 401. If an interrupt key 613 is pressed by the user, the controller unit 205 suspends the printing of the job currently printed by the printing apparatus 100 and starts the printing of the newly input job. If an application mode key 618 is pressed, the controller unit 205 displays, on the touch panel unit 401, a screen for setting various types of image processing and a layout, such as a continuous copy of pages, a setting for a cover and a inserted sheet, a reduction layout, and an image moving setting.

In addition, for a setting for the job to be processed, the controller unit 205 displays, on the UI unit, for receiving a user request for executing sheet processing by a sheet processing unit included in the inline type sheet processing apparatus 200.

A display for receiving a user instruction to execute the above-described display on the UI unit itself is executed by the UI unit. For example, the controller unit 205 displays a sheet processing setting key 609 (FIG. 6) on the touch panel unit 401. If the sheet processing setting key 609 is been pressed by the user, the controller unit 205 executes control for displaying, on the touch panel unit 401, a display for enabling the user to specify desired sheet processing from among selection candidates of the sheet processing that can be executed by the inline type sheet processing apparatus 200 included in the printing system 1000.

The sheet processing setting key 609 illustrated in FIG. 6 is also referred to as a "finishing key". In other words, the sheet processing setting key 609 is the same button for executing finishing. Accordingly, in the following description, the sheet processing will be also referred to as "finishing". For punching processing, the user may desire various types of punching processing (processing for providing a hole to a printed sheet) in the POD environment. Accordingly, in the present exemplary embodiment, a plurality of types of punching processing, such as "two-hole punching" and "multi-hole punching", can be executed. The two-hole punching refers to processing for providing two holes on the edge of the printed sheet, which corresponds to a binding edge of the sheet. The multi-hole punching refers to processing for providing a multiple of holes (for example, thirty holes) on the edge of the sheet.

Figure 8:
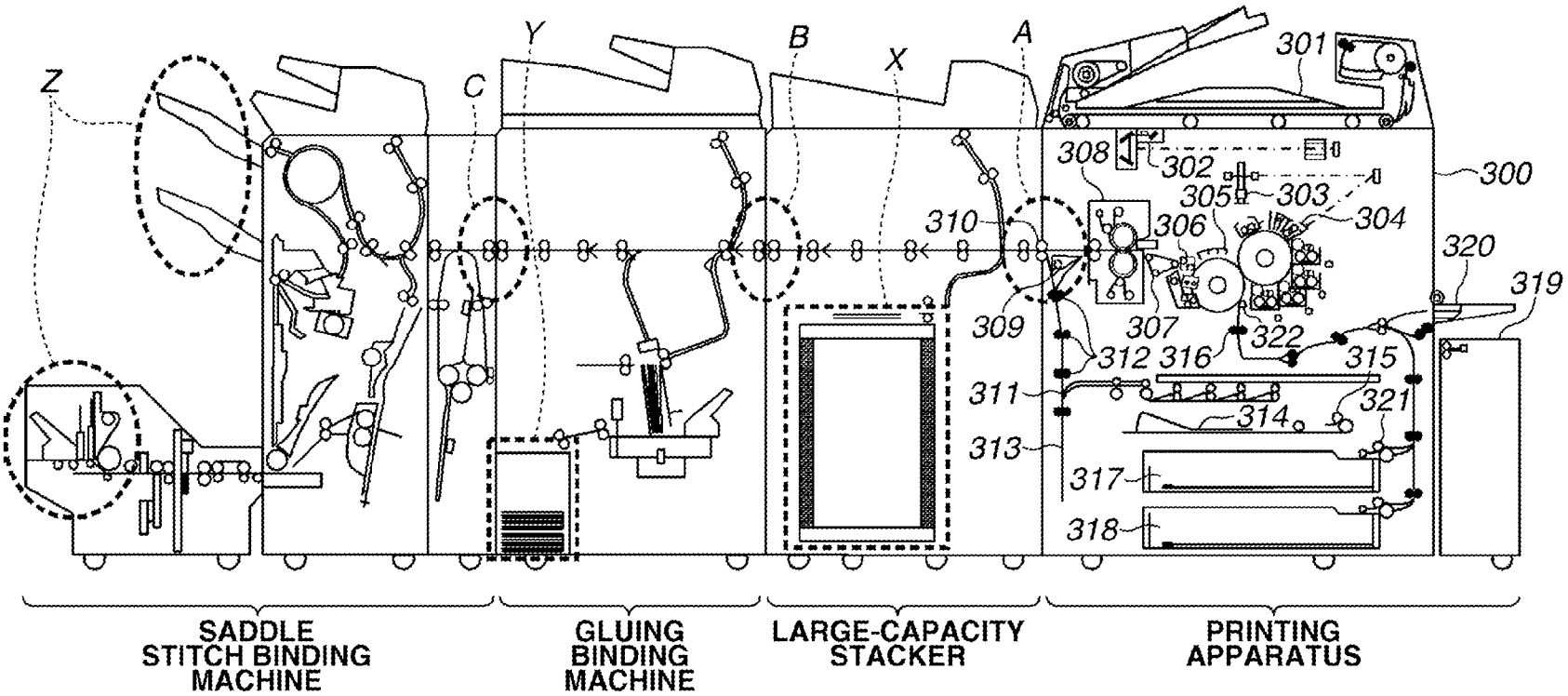
FIG. 8 illustrates an example of a connection state of sheet processing apparatuses included in the printing system.

The above-described punching processing can be executed by a punching unit included in the saddle stitch binding machine illustrated in FIG. 8 in order to employ and implement the above-described configuration. FIG. 8 illustrates an example of a connection state of the sheet processing apparatuses included in the printing system 1000. Alternatively, the above-described punching processing can be executed using an apparatus or a unit different from those described above. However, as described above, in the present exemplary embodiment, an apparatus that is compliant with the definition of the inline finisher is permitted to be utilized within the printing system 1000 but the use of any apparatus that is not compliant with the definition of the inline finisher is inhibited in the printing system 1000.

Figure 7:
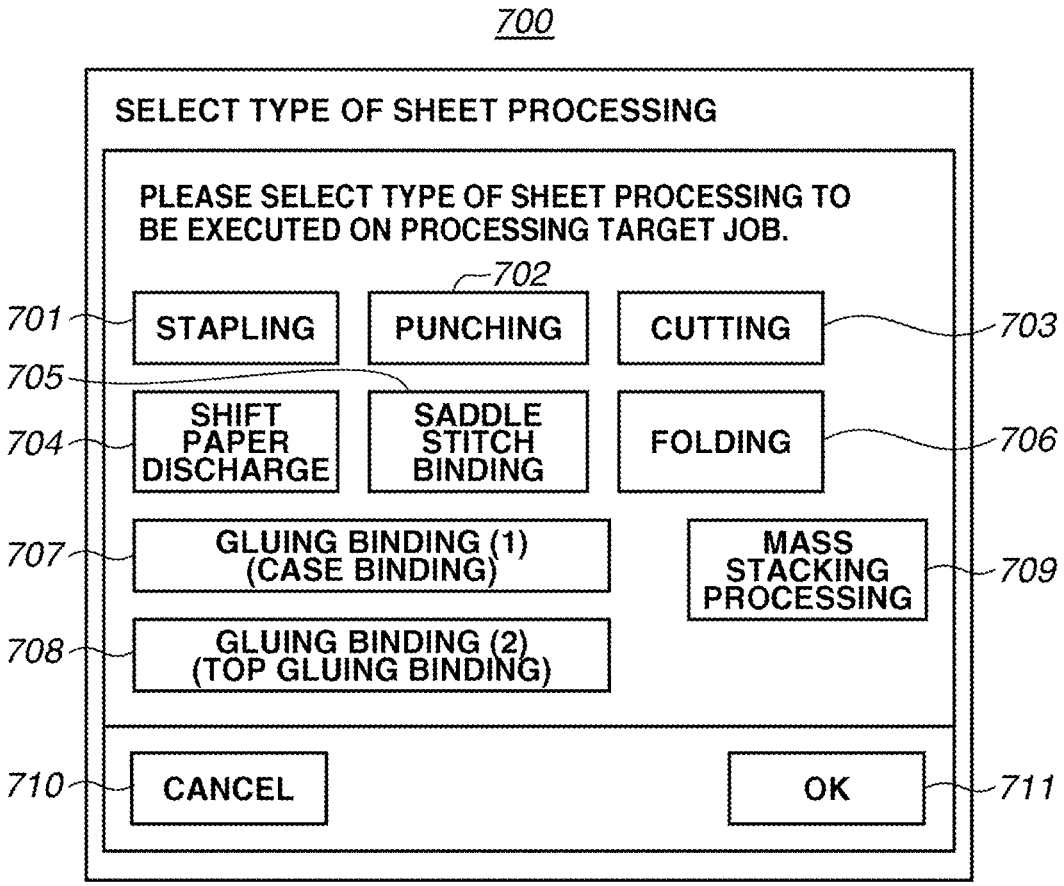
FIG. 7 illustrates an example of a UI displayed on the operation unit illustrated in FIG. 2.

For example, in the present exemplary embodiment, the controller unit 205 displays a screen illustrated in FIG. 7 on the touch panel unit 401 in response to the pressing of the sheet processing setting key 609 by the user. Further, the controller unit 205 receives a request for executing the sheet processing to be executed on the sheet printed by the job to be processed using the sheet processing apparatus 200 via the display screen illustrated in FIG. 7.

The controller unit 205 determines what type of sheet processing apparatus is included in the printing system 1000 as the candidate for the sheet processing apparatus that can be selected via the display illustrated in FIG. 7 according to an installation status of the sheet processing apparatus. More specifically, the controller unit 205 receives, from the user, a request for executing either one of types of the sheet processing from among the following plurality of types of sheet processing (1) through (9) on the sheet printed by the printer unit 203 via the display illustrated in FIG. 7.

The sheet processing includes the following types.

(1) Stapling
(2) Punching
(3) Folding
(4) Shift paper discharge processing
(5) Cutting
(6) Saddle stitch binding
(7) Case binding processing, which is an example of gluing binding processing 1
(8) Top gluing binding processing, which is another example of the gluing binding processing
(9) Mass stacking processing In an example of UI control illustrated in FIG. 7, the controller unit 205 controls the operation unit 204 to enable the user to select the sheet processing from among the nine types of sheet processing that are the selection candidates. The above-described control is executed because the nine types of sheet processing can be selectively executed by utilizing the inline type sheet processing apparatuses included in the printing system 1000.

In other words, the controller unit 205 controls the UI unit to exclude the sheet processing of a type that cannot be executed by the printing system 1000 from the selection candidates in the display illustrated in FIG. 7. For example, it is supposed that the printing system 1000 does not include any sheet processing apparatus that can selectively execute the case binding and the top gluing binding, or that the sheet processing apparatus that can selectively execute the case binding and the top gluing binding but the sheet processing apparatus included in the printing system 1000 is not available because of a failure or malfunction. In this case, the controller unit 205 executes control for disabling the selection of keys 707 and 708.

For example, in this case, the controller unit 205 executes graying out or hatching the display of the buttons 707 and 708. In this manner, the controller unit 205 executes control not for receiving a request for executing the sheet processing from the user. To paraphrase this, if the print system 1000 includes a sheet processing apparatus which can execute sheet processing other than the sheet processing included in the nine types of sheet processing candidates described above, the controller unit 205 executes control for displaying the display key for receiving a request for executing the sheet processing from the user in an enabled state on the display illustrated in FIG. 7.

In the above-described manner, the controller unit 205 permits receiving of the user request for executing the sheet processing. In the present exemplary embodiment, the above-described display control can be executed in addition to the job processing control. Accordingly, the present exemplary embodiment can effectively prevent an operational error by the user.

In executing the above-described control, the controller unit 205 acquires system configuration information for specifying what type of sheet processing apparatus 200 is included in the printing system 1000.

The controller unit 205 utilizes status information for specifying whether any error has occurred on the sheet processing apparatus 200 during the above-described control. The controller unit 205 acquires the above-described information pieces by a manual input by the user via the UI unit. Alternatively, the controller unit 205 can automatically acquire the above-described information pieces according to a signal output via a signal line by the sheet processing apparatus 200 itself when the sheet processing apparatus 200 is connected to the printing apparatus 100.

With the above-described configuration as a premise, the controller unit 205 executes the display illustrated in FIG. 7 on the touch panel unit 401 using the contents of the display based on the acquired information. The printing system 1000 receives a request for executing printing of the job to be processed and a request for executing sheet processing required for the job from the external apparatus, such as the SC 103 and the PC 104.

If a job is input by the external apparatus in the above-described manner, the controller unit 205 executes control for displaying the similar function to the display illustrated in FIG. 7 on the display unit of the external apparatus, which is a transmission source apparatus of print data. For example, in the present exemplary embodiment, a printer driver setting screen, which will be described in detail below, is displayed on the display unit of a computer, such as the SC 103 or the PC 104.

In executing the display on the UI of the external apparatus, a control unit (not illustrated) of the external apparatus executes the above-described control. More specifically, if a printer driver UI screen, which will be described in detail below, is displayed on a display unit of the SC 103 or the PC 104, the CPU (not illustrated) of the external apparatus (PC) executes the control.

[Inner Configuration of the Finisher Apparatus]

Figure 9:
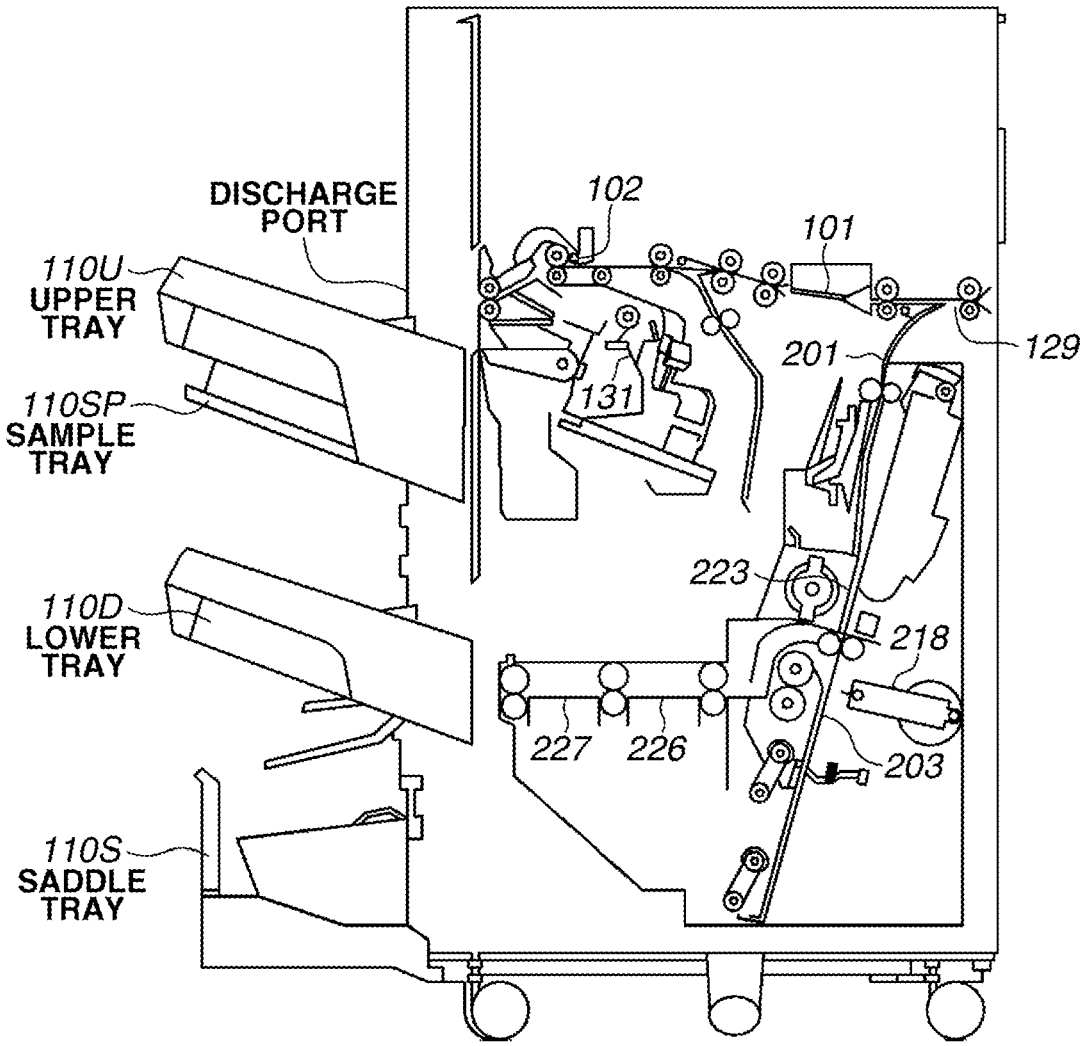
FIG. 9 is a cross section illustrating an exemplary configuration of the sheet processing apparatus included in the printing system.

FIG. 9 is a cross section illustrating an exemplary configuration of the sheet processing apparatus included in the printing system 1000. The sheet processing apparatus illustrated in FIG. 9 is an example of the sheet processing apparatus included in the printing system 1000 illustrated in FIG. 3. More specifically, FIG. 9 is a cross section illustrating an exemplary inner configuration of the saddle stitch binding machine (hereinafter simply referred to as a finisher apparatus) 110, which is controlled by the controller unit 205.

Referring to FIG. 9, the finisher apparatus 110 includes an inner sheet conveyance path and four paper discharge trays onto which the sheets can be discharged. The four paper discharge trays include an upper tray 110U, a sample tray 110SP, a lower tray 110D, and a saddle tray 1105. The upper tray 110U, the sample tray 110SP, and the lower tray 110D can move via a guide (not illustrated).

More specifically, the upper tray 110U, the sample tray 110SP, and the lower tray 110D can move up and down in a vertical direction with respect to the plane of the drawing. For the amount of the elevation of the tray, the controller unit 205 controls the tray to move to a position equivalent to the position of a sheet discharge port according to a detected output from a sensor.

In the present exemplary embodiment, it is supposed that the upper tray 110U has the stacking capacity of 1000 sheets and the lower tray 110D has the stacking capacity of 2000 sheets, for example. As described above, the upper tray 110U, the sample tray 110SP, and the lower tray 110D, which function as the paper discharge trays of the finisher apparatus 110, namely the sheet processing apparatus according to the present exemplary embodiment, have different sheet stacking capacities.

In the sheet conveyance path of the finisher apparatus 110, a plurality of sheet detection sensors are provided. The sheet detection sensor is used for detecting the status of conveyance of the sheet and a paper jam, if any occurs. A CPU (not illustrated) of the finisher apparatus 110 notifies the controller unit 205 of sheet detection information, which is acquired from each of the plurality of sensors, via a signal line used for data communication with the controller unit 205. The signal line refers to a signal line for electrically connecting the controller unit 205 with the sheet processing apparatus 200 illustrated in FIG. 2.

The controller unit 205 recognizes the sheet conveyance state and a paper jam, if any, inside the finisher apparatus 110 according to the information from the finisher apparatus 110. For the system configuration of the printing apparatus 100, if another sheet processing apparatus is cascade-connected between the sheet processing apparatus 200 and the printing apparatus 100, the information from the sensor of the finisher apparatus 110 is notified to the controller unit 205 via a CPU of another sheet processing apparatus. As described above, the finisher apparatus 110 includes a configuration unique to an inline finisher.

Suppose that the printing system 1000 includes the finisher apparatus 110. Further in this system configuration, suppose that the user has operated the mass stacking processing key 709 illustrated in FIG. 7 and that the controller unit 205 has received a request for executing sheet stacking processing from the user via the UI unit, which can be executed by the finisher apparatus 110, for the job to be processed.

In this case, the controller unit 205 executes control for conveying the sheet to the paper discharge tray of the finisher apparatus 110. Further, the controller unit 205 causes the paper discharge tray to move to a position equivalent to a predetermined sheet discharge port. Then, the sheet is discharged on the elevated paper discharge tray. In the present exemplary embodiment, the finisher apparatus 110 includes at least the upper tray 110U and the lower tray 110D as the paper discharge tray.

In discharging the sheet onto the upper tray 110U illustrated in FIG. 9, the upper tray 110U is descended to the position of the sheet discharge port by driving an elevation mechanism (not illustrated). In discharging the sheet onto the lower tray 110D, the upper tray 110U and the lower tray 110D are driven by the elevation mechanism to be elevated to the position equivalent to the position of the sheet discharge port so that the sheet can be discharges onto the lower tray 110D. By elevating the tray to the height of the sheet discharge port, the sheet discharged from the sheet discharge port can be securely discharged and stacked.

Accordingly, in the finisher apparatus 110 described above, in order to utilize the stacking capacity of the lower tray 110D at the maximum, it is useful to execute the stacking of the sheets starting from the upper tray 110U. In executing the discharge of sheets onto the upper tray 110U, it is necessary to descend the upper tray 110U to secure a sufficiently low position when sheets are output and discharged thereon. In the present exemplary embodiment, it is supposed that the output restriction amount of the upper tray 110U is 1000 sheets and the maximum stacking amount of the lower tray 110D is 2000 sheets.

Although it is necessary to descend the upper tray 110U to a sufficiently low position, if a large amount of sheets has been already stacked on the lower tray 110D, the upper tray 110U cannot be descended to a sufficiently low position. Accordingly, because the upper tray 110U cannot be appropriately descended, sheets cannot be stacked onto the upper tray 110U. As a result, the stacking capacity of the trays cannot be fully utilized.

In the example illustrated in FIG. 9, the saddle tray has a post-processing function, such as a saddle stitch binding function. To the paper discharge tray provided inside the finisher apparatus 110, a sheet detection sensor for detecting the sheet stacking status and a tray-full state is provided.

As described above, the finisher apparatus 110, which is utilized as the inline type sheet processing apparatus of the printing system 1000, is capable of stacking sheets from the printer unit 203 onto a plurality of types of paper discharge trays. The controller unit 205 can control various operations by the finisher apparatus 110.

An exemplary control executed by the printing system 1000 according to the first exemplary embodiment having a system configuration illustrated in FIG. 8 will be described in detail below with reference to a flow chart in FIG. 10. The exemplary control is executed when the user designates the sheet stacking processing, such as the stapling 701, the shift discharge processing 704, and the mass stacking processing 709 illustrated in FIG. 7 and inputs a job.

Figure 10:
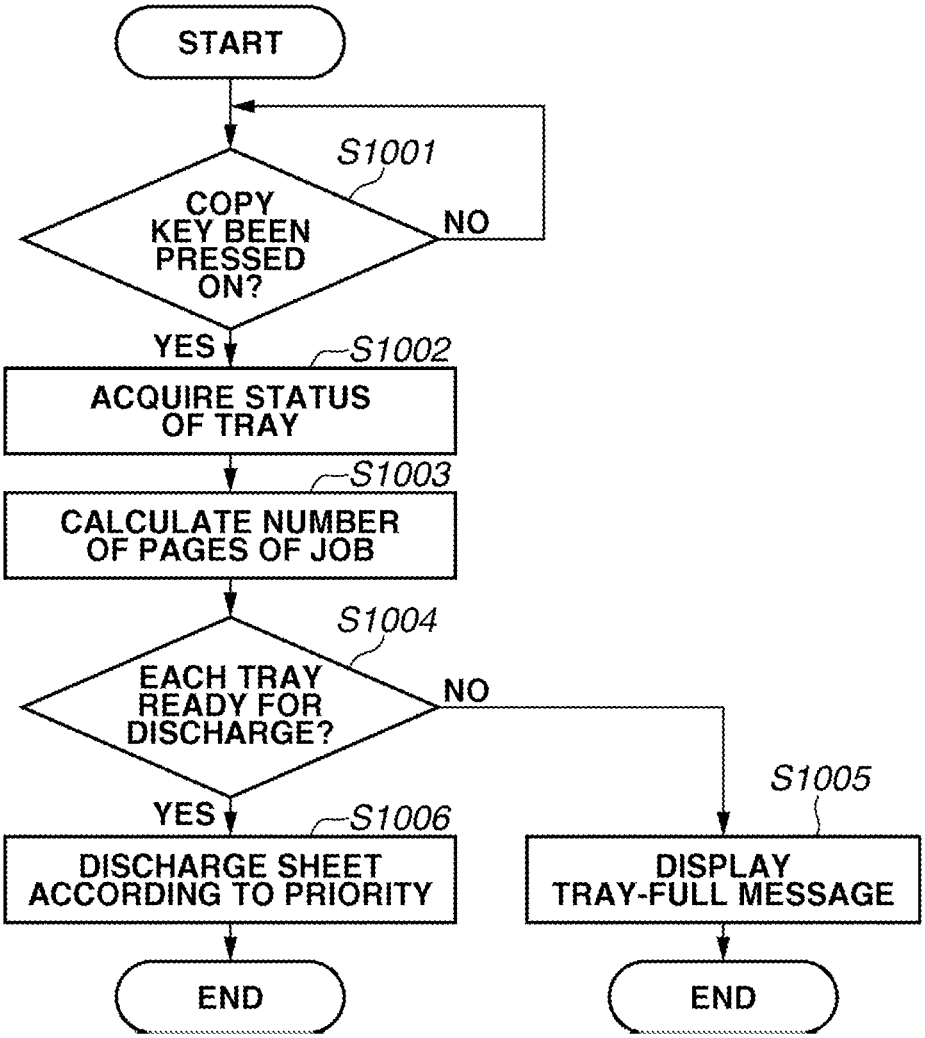
FIG. 10 is a flow chart illustrating exemplary sheet processing executed by the printing system.

FIG. 10 is a flow chart illustrating exemplary sheet processing executed by the printing system 1000 according to the present exemplary embodiment. Processing illustrated in the flow chart in FIG. 10 can be implemented by the controller unit 205 in FIG. 2 by loading a control program stored in the ROM 207 and the HDD 209 on the RAM 208 and executing it.

Referring to FIG. 10, first, the user sets an output destination from a large-capacity paper feed apparatus 319 via the operation unit 204 of the printing apparatus 100. In step S1001, the controller unit 205 determines whether a copy start key has been pressed by the user after the setting. In step S1001, the controller unit 205 waits until the copy start key is pressed ON.

If it is determined that the user has operated the operation unit 204 and pressed the copy start key ON (Yes in step S1001), then the processing advances to step S1002. In step S1002, the controller unit 205 acquires the status of the tray from the CPU of the finisher apparatus 110.

In step S1003, the controller unit 205 calculates the number of pages of the job set by the user. More specifically, the controller unit 205 calculates the number of pages (the number of sheets) to be discharged by executing the job according to the number of documents that have been read by the scanner unit 201.

In step S1004, the controller unit 205 determines whether a plurality of trays is necessary for discharging the sheets according to the number of pages of the job set by the user. For example, suppose that the upper tray 110U and the lower tray 110D have been set as the output trays, and that the maximum stacking capacity of the upper tray 110U is 1000 sheets and the lower tray 110D has the maximum stacking capacity of 2000 sheets. In this case, if the total number of pages of one input job is 6000 sheets, the controller unit 205 determines that both of the upper tray 110U and the lower tray 110D will be used at least twice to completely discharge the sheets output by the job by fully utilizing the stacking capacity of each of the upper tray 110U and the lower tray 110D.

If it is determined that a plurality of trays is necessary for discharging the sheets of the job in step S1004, then the controller unit 205 further determines whether each tray is ready for discharging the sheet. If it is determined that all the trays are ready for discharging the sheet (Yes in step S1004), then the processing advances to step S1006. In step S1006, the controller unit 205 determines the output order for the trays including the upper tray 110U and the lower tray 110D according to a priority order setting, which is set via a screen illustrated in FIG. 11.

Then the controller unit 205 feeds the sheet from the large-capacity paper feed apparatus 319. The read image is printed on the sheet by a printing apparatus 300. Further, in step S1006, the controller unit 205 discharges the sheet having the image printed thereon onto the tray determined according to the priority setting illustrated in FIG. 11. Then the processing ends. If it has been set by the user to execute post-processing on the sheet, the controller unit 205 executes post-processing, such as stapling and punching, on the sheet having the image printed thereon and discharges the sheet.

Figure 11:
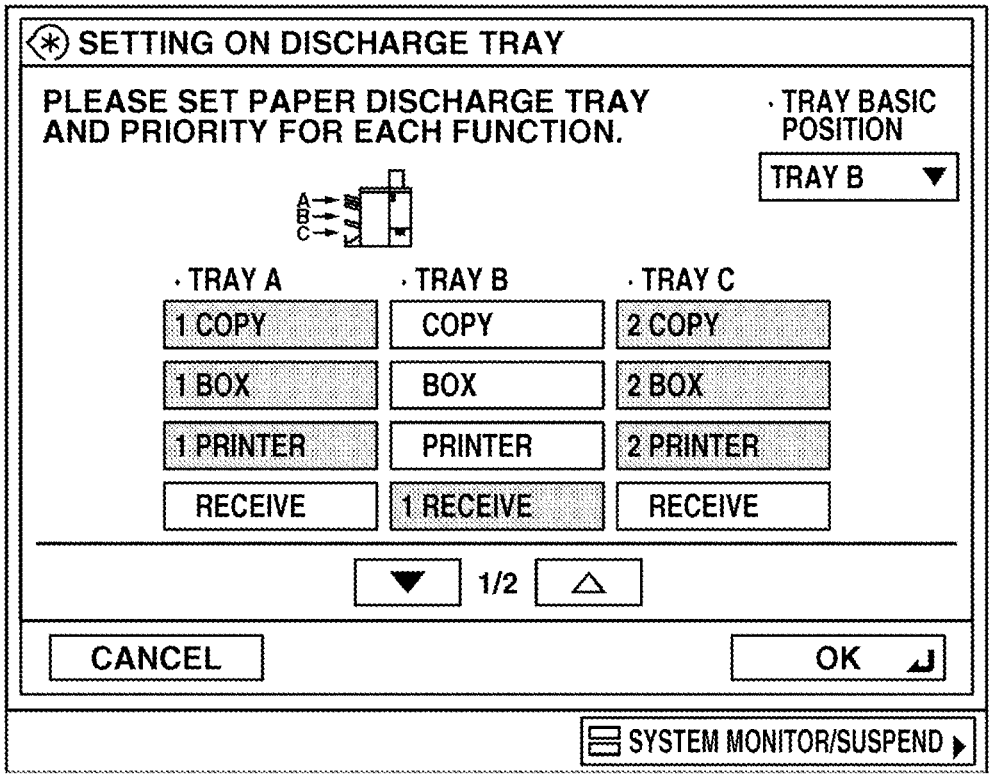
FIG. 11 illustrates an example of a UI displayed on an operation unit 204 illustrated in FIG. 2.

FIG. 11 illustrates an example of a user interface to be displayed on the operation unit 204 illustrated in FIG. 2. The screen illustrated in FIG. 11 is an example of a paper discharge tray priority order setting screen. Referring to FIG. 11, the user can set the priority of discharging the sheets on the paper discharge tray for each type of job corresponding to a plurality of functions, such as a copy job and a PDL job. The priority order can be set at three levels including the levels 1 to 3.

In the example illustrated in FIG. 11, "copy" indicates that the setting for a copy job has been set to the corresponding tray. "Printer" indicates that the setting for a PDL job has been set. Further, "box" indicates that the setting for a box job has been set. A box job is a job in which print data read by the scanner unit 201 or received from the external I/F 202 is stored on the HDD 209 and printing of the print data stored on the HDD 209 is executed according to a user instruction. In the example illustrated in FIG. 11, "receive" indicates that a setting for a FAX receiving job has been set. A FAX receiving job is a job for printing based on data received via a public line (not illustrated) by the printer unit 203.

The set priority order information is stored on a non-volatile memory, such as the HDD 209 or a non-volatile random access memory (NVRAM) and is managed by the controller unit 205. In step S1006, the controller unit 205 executes control for discharging the sheet onto the paper discharge tray to which a high priority order has been set via the priority order setting screen.

On the other hand, if it is determined that no tray is ready for discharging the sheet (No in step S1004), then the processing advances to step S1005. In step S1005, the controller unit 205 executes a tray-full display on the operation unit 204 for prompting the user to remove the sheet. Then the processing ends.

Figure 12:
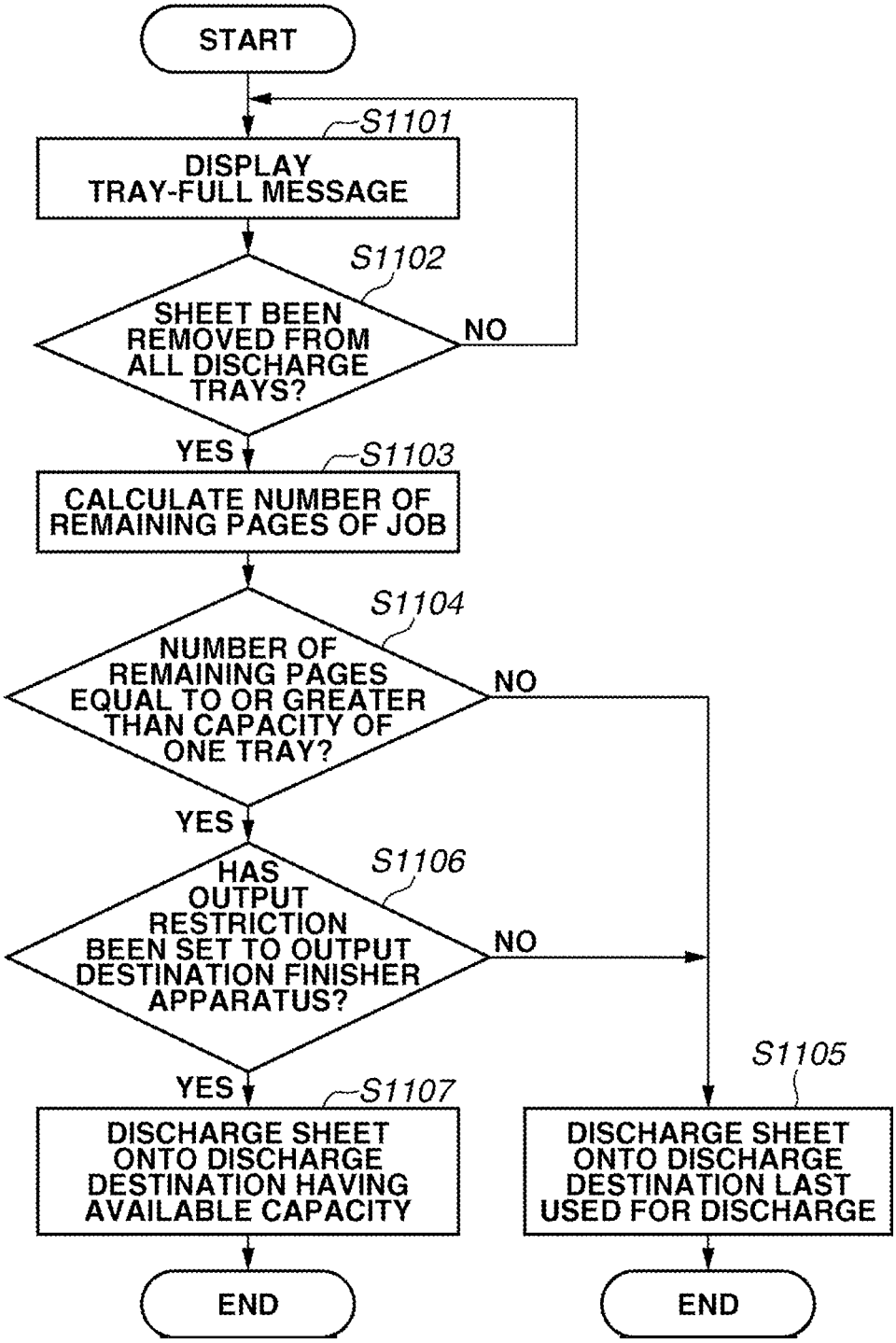
FIG. 12 is a flow chart illustrating exemplary sheet processing executed by the printing system.

Processing to be executed when a tray-full state occurs during the operation for outputting the sheets on the sheet discharge destination determined in step S1006 will be described in detail below with reference to a flow chart of FIG. 12. FIG. 12 is a flow chart illustrating exemplary sheet processing executed by the printing system 1000 according to the present exemplary embodiment. Processing illustrated in the flow chart in FIG. 12 can be implemented by the controller unit 205 in FIG. 2 by loading a control program stored in the ROM 207 and the HDD 209 on the RAM 208 and executing it.

In the present exemplary embodiment, due to the predetermined restriction of the finisher apparatus, it is supposed that if the sheets are output in the stacking order starting from the upper tray 110U to the lower tray 110D, up to 3000 sheets can be stacked, whereas, if the sheets are output in the stacking order starting from the lower tray 110D to the upper tray 110U, up to 2000 sheets can be stacked. In the latter case, sheets are not output to the upper tray 110U because there is no space for the upper tray 110U to descend.

When the sheets are output onto the upper tray 110U and then to the lower tray 110D and if the tray-full state has occurred on each tray, the controller unit 205, in step S1101, displays a message to instruct the user to remove the sheet from the trays on the operation unit 204.

In step S1102, the controller unit 205 waits until the user removes the sheets from the upper tray 110U or the lower tray 110D. The controller unit 205 determines whether the discharged sheets have been removed from the upper tray 110U and the lower tray 110D according to a state detected by the sensor for detecting the presence or absence of sheet on the upper tray 110U and the lower tray 110D.

If it is determined that the sheets have been removed from the upper tray 110U or the lower tray 110D (Yes in step S1102), then the processing advances to step S1103. In step S1103, the controller unit 205 calculates the number of remaining pages of the sheets to be discharged by the currently executed job based on the number of pages calculated in step S1003 in FIG. 10.

In step S1104, the controller unit 205 compares the sheet stacking amount of the paper discharge tray and the number of remaining pages and determines whether the number of remaining pages is equal to or larger than the maximum stacking amount of one tray.

In this state, the lower tray 110D can stack 2000 output sheets but the number of remaining sheets to be output is 3000 sheets. Accordingly, if the sheets are output starting from the lower tray 110D, the sheets cannot be stacked on the upper tray 110U. Thus, in step S1106, the controller unit 205 determines whether any output restriction for elevating the upper tray 110U or the lower tray 110D is set to each tray of the finisher apparatus 110, which is the paper discharge destination.

If it is determined that the output restriction for descending the upper tray 110U is set (Yes in step S1106), then the controller unit 205 changes the paper discharge order for discharging the sheets onto the upper tray 110U or the lower tray 110D, which has been set by the user according to the priority order for discharging the sheets in the above-described manner. In step S1107, the controller unit 205 executes control for discharging the sheets of the remaining pages prioritizedly from the upper tray 110U. Then the processing ends.

On the other hand, if it is determined that it is not necessary to change the tray for discharging the remaining pages in steps S1104 and S1106 (No in steps S1104 and S1106), then the processing advances to step S1105. For example, if it is determined that the number of remaining pages is equal to or less than the restriction of the stacking amount of one tray (No in step S1104) or if it is determined that no output restriction is set to the output destination finisher apparatus 110 (No in step S1106), then the processing advances to step S1105.

In step S1105, the controller unit 205 outputs the remaining pages onto the lower tray 110D, which has been used last for outputting the sheets. Then the processing ends.

Figure 13:
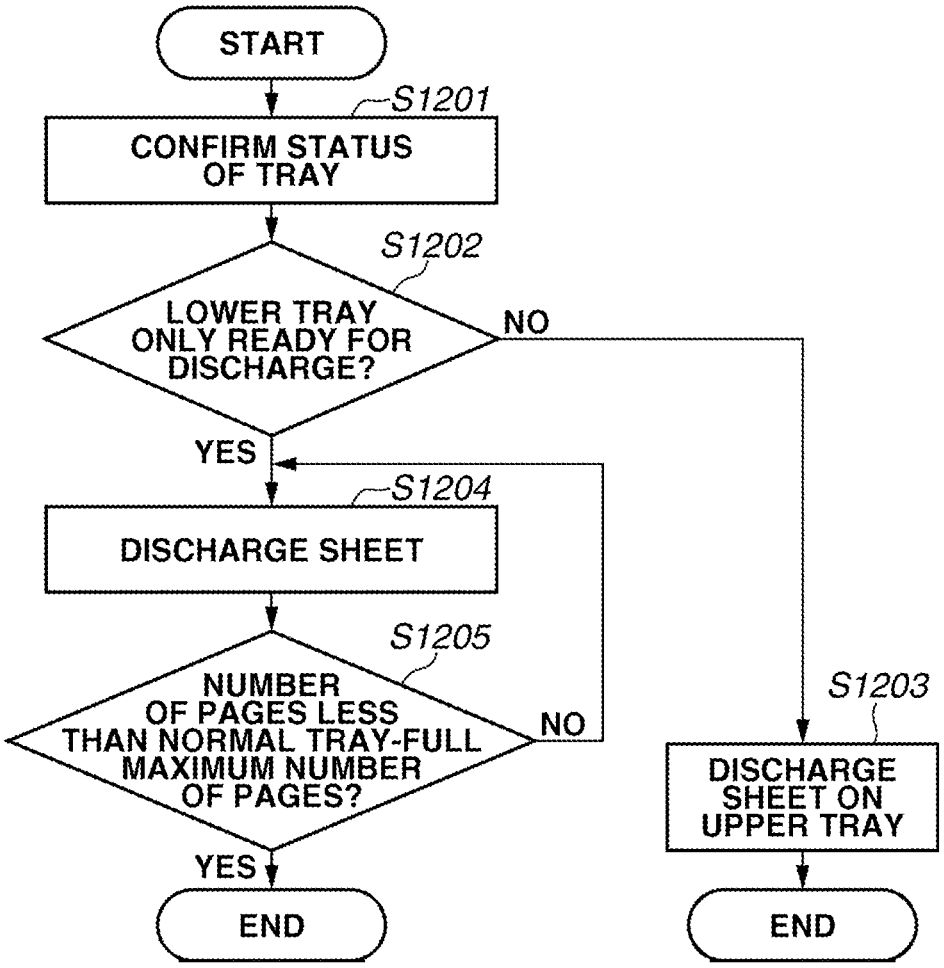
FIG. 13 is a flow chart illustrating exemplary sheet processing executed by the printing system.

Processing executed if a tray having the high priority order determined in step S1006 but whose maximum stacking amount is less than the number of sheets to be stacked will be described in detail below with reference to FIG. 13. FIG. 13 is a flowchart illustrating exemplary sheet processing executed by the printing system 1000 according to the present exemplary embodiment. Processing illustrated in the flow chart in FIG. 13 can be implemented by the controller unit 205 in FIG. 2 by loading a control program stored in the ROM 207 and the HDD 209 on the RAM 208 and executing it.

As described above, in the present exemplary embodiment, due to the predetermined restriction of the finisher apparatus, it is supposed that if the sheets are output in the stacking order starting from the upper tray 110U to the lower tray 110D, up to 3000 sheets can be stacked, whereas, if the sheets are output in the stacking order starting from the lower tray 110D to the upper tray 110U, up to 2000 sheets can be stacked. In the latter case, sheets are not output to the upper tray 110U because there is no space for the upper tray 110U to descend.

Referring to FIG. 13, in step S1201, if it has been set to discharge the sheets in the priority order from the lower tray 110D to the upper tray 110U, the controller unit 205 checks the state of each tray.

In step S1202, the controller unit 205 determines whether the sheets can be discharged only onto the lower tray 110D according to an output from the above-described sensor for detecting the presence or absence of a sheet to be discharged. If the total number of pages calculated in step S1003 is larger than the maximum stacking amount of the discharge target tray and if any restriction on the discharge order has been set, in step S1205, the controller unit 205 restricts the number of sheets to be output.

For example, if the sheets are discharged onto the trays in order from the lower tray 110D to the upper tray 110U, the controller unit 205 restricts the number of sheets to be discharged onto the lower tray 110D to about 1500 sheets to secure a sufficient space into which the upper tray 110U is descended.

When 1500 sheets are completely output onto the lower tray 110D, the controller unit 205 changes the sheet discharge destination from the lower tray 110D to the upper tray 110U to securely stack the remaining sheets to be stacked. In this manner, the sheet discharge destination can be changed to the upper tray 110U before the amount of sheets stacked on the lower tray 110D reaches the maximum stacking amount thereof. As a result, the upper tray 110U can descend to the position equivalent to the sheet discharge port. In addition, by discharging the sheets within the sheet stacking capacity of the upper tray 110U, it is enabled to continuously discharge at least 2500 (=1500+1000) sheets.

As compared to the above-described case in which 2000 sheets can be stacked in total are discharged only on the lower tray 110D, the number of the sheets stacked on the lower tray 110D are actually 500 sheets fewer than the maximum stacking amount of 2000 sheets that can be stacked on the lower tray 110D. However, in this case, the upper tray 110U can be appropriately descended to the position of the sheet discharge port. Accordingly, it is enabled to use the upper tray 110U during the processing of one job and 1000 sheets, that is the output restriction amount of the upper tray 110U, can be stacked on the upper tray 110U. As a result, 2500 sheets can be discharged at the maximum in this case.

Suppose that 2450 sheets are to be discharged by one job (for example, a print job) and that the lower tray 110D is set as the paper discharge tray in priority by the user in the setting of the priority order for discharging the sheets for the print job.

According to the present exemplary embodiment, the continuous discharge of 2000 sheets on the lower tray 110D is not to be executed. The controller unit 205 executes control for discharging 1500 sheets on the lower tray 110D, and then the controller unit 205 changes the paper discharge destination to the upper tray 110U. Further, the controller unit 205 executes control for continuously discharging 950 sheets on the upper tray 110U which is changed to the paper discharge destination.

As a result, the continuous discharge of 2000 sheets on the lower tray 110D is not executed even if the user has set the lower tray 110D as the priority paper discharge destination for one print job. Therefore, it becomes unnecessary for the user to remove 2000 sheets stacked on the lower tray 110D during the processing of one job. Accordingly, the burden on the user of the work for the discharged sheets can be substantially reduced.

On the other hand, in step S1202, if it is determined that the sheets can be stacked on the upper tray 110U (No in step S1202), then the processing advances to step S1203. In step S1203, the controller unit 205 discharges the subsequently sheets onto the upper tray 110U. Then the processing ends.

Figure 14:
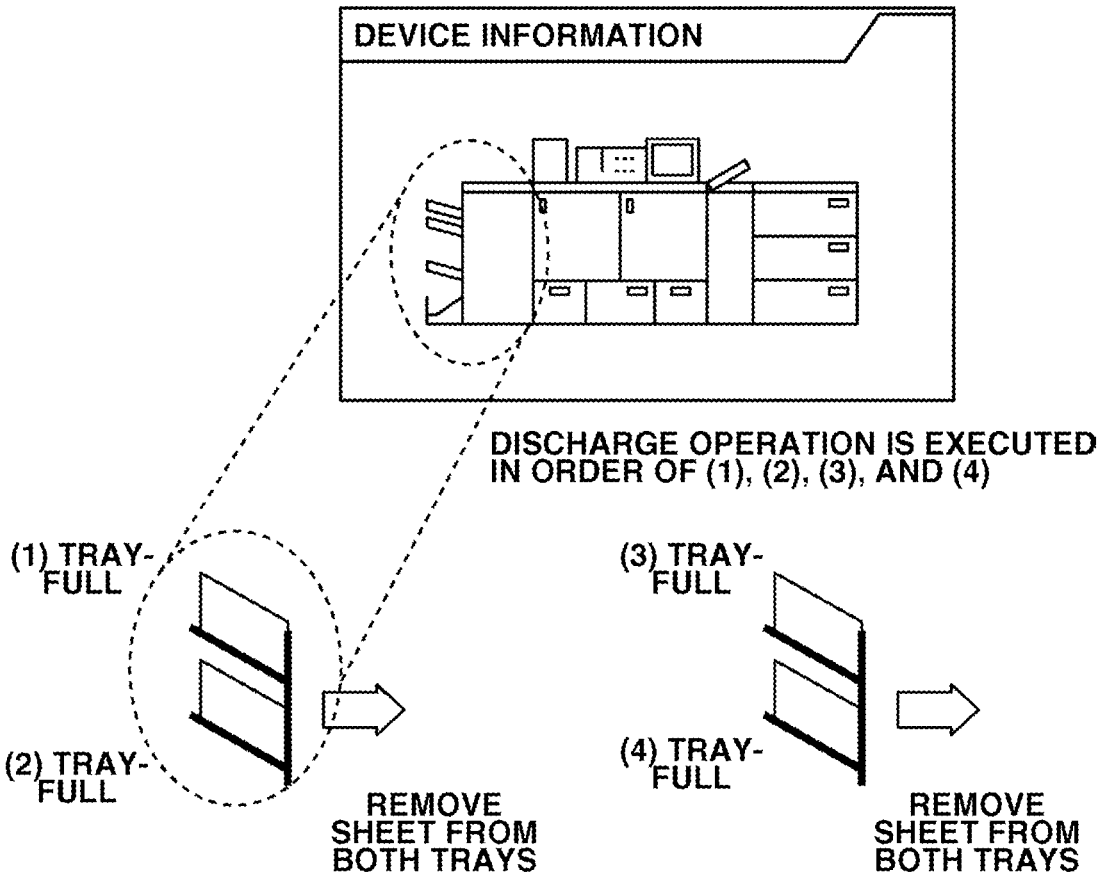
FIG. 14 illustrates exemplary paper discharge processing executed by the printing system.

In the present exemplary embodiment, if sheets printed by a job including a large number of pages are to be discharged to the finisher apparatus 110 in the printing apparatus 100 according to the present exemplary embodiment, the sheets are to be discharged to the paper discharge destination illustrated in FIG. 14. FIG. 14 illustrates exemplary paper discharge processing executed by the printing system 1000 according to the present exemplary embodiment.

Referring to FIG. 14, the tray-full state occurs on the upper tray 110U in a state (1), and then the tray-full state occurs on the lower tray 110D in a state (2). After the tray-full state of each tray is solved by the user by removing the sheets stacked on each tray, discharging the sheets on the tray is started from the upper tray 110U.

In a state (3), the tray-full state occurs on the upper tray 110U. Further, in a state (4), the tray-full state occurs on the lower tray 110D. After the tray-full state of each tray is solved by the user by removing the sheets stacked on each tray, discharging the sheets on the tray is started from the upper tray 110U.

As described above, in the present exemplary embodiment, if any output restriction is set to the finisher apparatus 110, the controller unit 205 always executes control for discharging the sheets onto the trays starting from the upper tray 110U differently from the set priority order.

According to the first exemplary embodiment having the above-described configuration, the number of times of removing the sheets from each tray, which operation being required for the user during processing of one input job including a large number of pages, can be substantially reduced. As a result, the burden on the user for the necessary work can be substantially reduced. In addition, the suspension of the processing of one job, which may occur due to a restriction on the sheet discharge amount, may not occur. As a result, the present exemplary embodiment can appropriately achieve a resulting high sheet output performance of one job.

The restriction of stacking the sheets onto each tray according to the present exemplary embodiment is a mere example and the sheet discharge capability is not limited to that described above in the present exemplary embodiment.

A second exemplary embodiment of the present invention will be described in detail below. In the second exemplary embodiment, the configuration and basic control of the printing system 1000 are similar to those of the first exemplary embodiment. Accordingly, difference points from the first exemplary embodiment only will be described in detail below.

Figure 15:
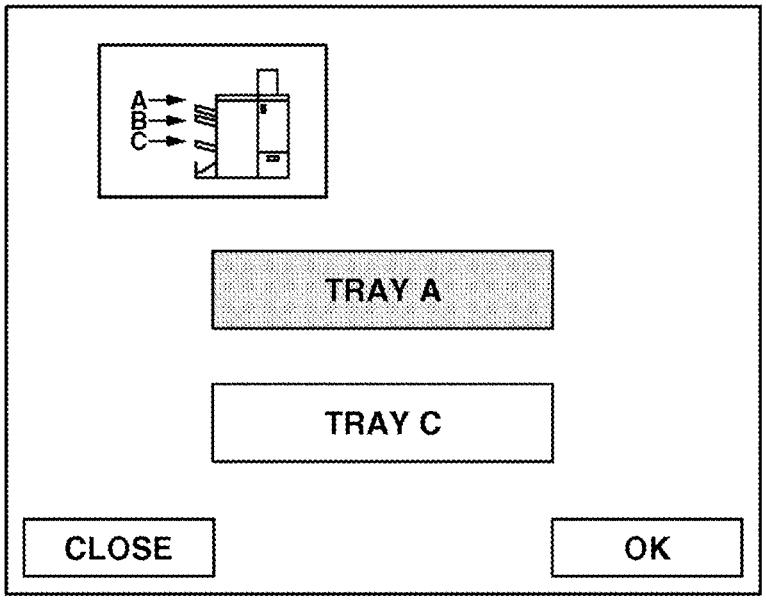
FIG. 15 illustrates an example of a UI displayed on the operation unit illustrated in FIG. 2.

In the second exemplary embodiment, in executing an operation for recovering from the tray-full state which is executed in the first exemplary embodiment described above, the controller unit 205 executes control for displaying a UI screen illustrated in FIG. 15 that enables the user to arbitrarily select an output tray to which the sheets are to be discharged after the tray-full state has occurred.

Processing to be executed when the tray-full state occurs to both the upper tray 110U and the lower tray 110D after discharging the sheets onto the paper discharge destination determined in step S1006 in FIG. 10 will be described. When the sheets are discharged onto the trays starting from the upper tray 110U and then to the lower tray 110D and after the tray-full state has occurred on each tray, the controller unit 205 displays an instruction on the operation unit 204, which prompts the user to remove the sheets from the upper tray 110U and the lower tray 110D.

After the user has removed the discharged sheets from the upper tray 110U and the lower tray 110D according to the displayed tray-full state instruction on the operation unit 204, the controller unit 205 displays a tray, which is the paper discharge destination after recovering from the tray-full state, as a UI screen illustrated in FIG. 15 according to the priority order that has been set to the job. Referring to FIG. 15, a tray A corresponds to the upper tray 110U, and a tray C corresponds to the lower tray 110D.

As described above in the first exemplary embodiment, as a result of the determination by the controller unit 205 based on the number of remaining pages, it is more effective to start the discharge of the sheets from the lower tray 110D during the processing of one job. Accordingly, the user executes an operation for changing the paper discharge destination tray from the currently selected upper tray 110U to the lower tray 110D. In other words, the present exemplary embodiment enables the user to arbitrarily select the lower tray 110D.

In the present exemplary embodiment, the user may select to start the output of the sheets from the upper tray 110U, in which the stacking amount is less effective due to the restriction set to the finisher. However, in this case, the controller unit 205 executes control of the sheet discharge amount to utilize the maximum stacking amount even if the discharge of the sheets has started from the lower tray 110D.

With the above-described configuration, the present exemplary embodiment can reduce the number of times of operations for removing the stacked sheets from the tray as desired by the user even if a job including a large number of pages is input. Accordingly, the present exemplary embodiment can achieve an optimally high sheet discharge efficiency.

A third exemplary embodiment of the present invention will be described in detail below. In the third exemplary embodiment, the configuration and basic control of the printing system 1000 are similar to those of the first exemplary embodiment. Accordingly, difference points from the first exemplary embodiment only will be described in detail below.

Figure 16:
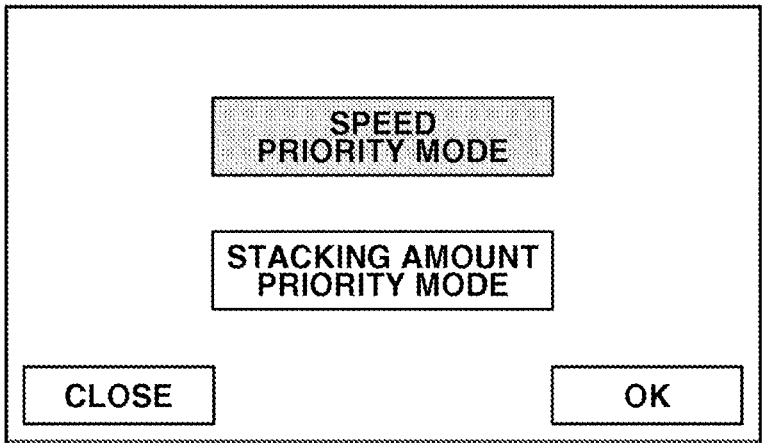
FIG. 16 illustrates an example of a UI displayed on the operation unit illustrated in FIG. 2.

In the third exemplary embodiment, in executing an operation for recovering from the tray-full state which is executed in the first exemplary embodiment described above, the controller unit 205 executes control for displaying a UI screen illustrated in FIG. 16 that enables the user to select a setting mode from a "speed priority mode" and a "stacking amount priority mode".

The user selects either one of the setting modes illustrated in FIG. 16, i.e., the "speed priority mode" or the "stacking amount priority mode", before starting the job. Once the user sets the setting mode, the set mode is stored on the HDD 209, so that the user does not need to execute the similar setting each time another job is executed.

Processing to be executed when the tray-full state occurs to both the upper tray 110U and the lower tray 110D after discharging the sheets onto the paper discharge destination determined in step S1006 in FIG. 10 will be described. When the sheets are discharged onto the trays starting from the upper tray 110U and then to the lower tray 110D and after the tray-full state has occurred on each tray, the controller unit 205 displays an instruction on the operation unit 204, which prompts the user to remove the sheets from the upper tray 110U and the lower tray 110D.

After the user has removed the discharged sheets from the upper tray 110U and the lower tray 110D according to the displayed tray-full state instruction on the operation unit 204, the user checks which of the "speed priority mode" and the "stacking amount priority mode" is currently set via the operation unit 204.

If the "stacking amount priority mode" is selected, the controller unit 205 compares the maximum stacking amounts of the respective trays as described above in the first exemplary embodiment. Further, the controller unit 205 executes control for starting the discharge of the sheets from the upper tray 110U, which has the larger total stacking amount of the two trays.

On the other hand, if the "speed priority mode" is selected, the tray last used for the sheet discharge operation is the lower tray 110D. If the paper discharge destination is changed to the upper tray 110U after the recovery and the sheets are output onto the upper tray 110U, time for changing to the upper tray 110U may be required.

Accordingly, the controller unit 205 executes control for starting the sheet discharge from the lower tray 110D, with which the sheets to be discharged can be output within shorter time to save the time of changing the tray.

With the above-described configuration, the present exemplary embodiment can achieve an optimally high sheet output efficiency if a job including a large number of pages is input as desired by the user.

As described with reference to FIG. 12, each exemplary embodiment of the present invention executes the above-described processing if the tray-full state has occurred on the stacking tray during printing of the job to be executed. However, the present invention is not limited to this. The processing in step S1104 and beyond can be executed after specifying the number of pages to be printed by executing the job before starting the printing of the job to be executed.

Aspects of the present invention can also be realized by a computer of a system or apparatus (or devices such as a CPU or a micro processing unit (MPU)) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A printing apparatus which has a plurality of trays for stacking sheets on which an image is printed, wherein stacking capability of a first tray included in the plurality of trays varies according to stacking status of a second tray included in the plurality of trays, and stacking capability of the second tray does not vary according to stacking status of the first tray, the printing apparatus comprising:

a controller unit configured to select, according to a user operation, the first tray or the second tray as a tray to be used;

accept an instruction to start a job;

control, when the instruction is accepted, such that sheets on which an image is printed based on the job are stacked on the selected first or second tray;

detect, after the selected first or second tray becomes full, that the sheets stacked on the selected first or second tray are removed; and control, after it is detected that the sheets stacked on the selected first or second tray are removed, such that other sheets on which an image is printed based on the job are stacked on the first tray regardless of the selection.

2. The printing apparatus according to claim 1, wherein the controller unit is configured to control, when the selected first or second tray becomes full, to continue the sheet stacking by switching a tray to be used from the selected first or second tray to other tray, and the controller unit is configured to detect, after both the selected first or second tray and the other tray become full, that both the sheets stacked on the selected first or second tray and the sheets stacked on the other tray are removed.

3. The printing apparatus according to claim 1, wherein the controller unit is configured to control, when the first tray becomes full, to continue the sheet stacking by switching a tray to be used from the first tray to the second tray.

4. The printing apparatus according to claim 1, wherein the controller unit is configured to obtain, after the selected first or second tray becomes full, a number of remaining sheets on which an image is to be printed based on the job, judge, based on the obtained number, whether the other sheets should be stacked on the first tray regardless of the selection or on the selected first or second tray, and control stacking of the other sheets according to a result of the judgment.

5. The printing apparatus according to claim 1, wherein the controller unit is configured to select the first tray or the second tray for each type of job corresponding to a plurality of functions.

6. The printing apparatus according to claim 1, wherein the job is a copy job.

7. The printing apparatus according to claim 1, wherein the first tray and the second tray are able to move up and down, and the first tray is set on an upper side of the second tray.

8. The printing apparatus according to claim 1, wherein stacking on the first tray is not possible after the second tray becomes full.

9. A control method for controlling a printing apparatus which has a plurality of trays for stacking sheets on which an image is printed, wherein stacking capability of a first tray included in the plurality of trays varies according to stacking status of a second tray included in the plurality of trays, and stacking capability of the second tray does not vary according to stacking status of the first tray, the method comprising:

a selecting step of selecting the first tray or the second tray as a tray to be used;

a first controlling step of controlling, when an instruction to start a job is accepted, sheets on which an image is printed based on the job, to be stacked on a tray selected in the selecting step;

a detecting step of detecting, after the tray selected in the selecting step becomes full as a result of sheet stacking controlled in the first control step, that the sheets stacked on the tray selected in the selecting step are removed; and a second control step of controlling, after it is detected that the sheets stacked on the tray selected in the selecting step are removed, other sheets on which an image is printed based on the job, to be stacked on the first tray regardless of a selection in the selecting step.

10. A non-transitory computer readable storage medium storing a program for causing a computer to execute the method defined by claim 9.

* * * * *